US006241349B1

(12) United States Patent
Harvey et al.

(10) Patent No.: US 6,241,349 B1
(45) Date of Patent: Jun. 5, 2001

(54) HIGH-DURABILITY INK CONTAINMENT UNIT FOR USE IN AN INK DELIVERY SYSTEM

(75) Inventors: James A. Harvey; Christie Dudenhoefer; William F. King; James P. Kearns; Mike M. Morrow, all of Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/239,444

(22) Filed: Jan. 28, 1999

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS

| | | | | |
|---|---|---|---|---|
| 4,329,698 | | 5/1982 | Smith | 347/68 |
| 4,415,886 | * | 11/1983 | Kyogoku et al. | 340/618 |
| 4,500,895 | | 2/1985 | Buck et al. | 347/87 |
| 4,509,062 | | 4/1985 | Low et al. | 347/87 |
| 4,749,291 | | 6/1988 | Kobayashi et al. | 400/124.1 |
| 4,771,295 | | 9/1988 | Baker et al. | 347/87 |
| 4,794,409 | | 12/1988 | Cowger et al. | 347/87 |
| 4,929,969 | | 5/1990 | Morris | 347/87 |
| 4,963,189 | | 10/1990 | Hindagolla | 106/31.52 |
| 5,147,682 | * | 9/1992 | Takiguchi et al. | 427/58 |
| 5,168,285 | | 12/1992 | Winslow | 347/87 |
| 5,185,034 | | 2/1993 | Webb et al. | 106/31.43 |
| 5,185,614 | | 2/1993 | Courian et al. | 347/24 |
| 5,278,584 | | 1/1994 | Keefe et al. | 347/63 |
| 5,359,353 | | 10/1994 | Hunt et al. | 347/86 |
| 5,719,609 | * | 2/1998 | Hauck et al. | 347/85 |
| 5,737,001 | | 4/1998 | Taylor | 347/85 |
| 5,759,653 | * | 6/1998 | Collette et al. | 428/35.9 |
| 5,780,130 | | 7/1998 | Hansen et al. | 428/35.7 |
| 5,939,153 | * | 8/1999 | Valyi | 428/1 |
| 6,083,639 | * | 7/2000 | McHugh et al. | 429/62 |

FOREIGN PATENT DOCUMENTS

| | | | |
|---|---|---|---|
| 0864437 | 9/1998 | (EP) | B41M/1/36 |
| 09084248 | 10/1998 | (JP) | B41J/2/175 |
| WO/98/31547 | 7/1998 | (WO) | B41J/2/175 |

OTHER PUBLICATIONS

U.S. application No. 08/869,446, Olsen et al., filed Jun. 5, 1997.

U.S. application No. 08/873,612, Hauck et al., filed Jun. 11, 1997.

*Hewlett–Packard Journal,* vol. 39, No. 4 (Aug. 1988).

*Encyclopedia of Polymer Science and Engineering* (Kroschwitz, J. ed.), vol. 9 (entitled Liquid Crystalline Polymers to Mining Applications), John Wiley & Sons, Inc., New York (1987), pp. 1–8.

Product Literature Sheet from Hoechst Celanese entitled "Vectra® Liquid Crystal Polymer", Short Term Properties (VC–4)—(1992).

Product Literature Sheet from Hoechst Celanese entitled "Processing Vectra® Liquid Crystal Polymer", Processing and Troubleshooting Guide (VC–6)—(1992).

Kaslusky, A., "New resins form complex heat–resistant parts without warping", *Modern Plastics Encyclopedia 98,* (Mid–Nov. 1997 edition), p. B–69.

* cited by examiner

*Primary Examiner*—N. Le
*Assistant Examiner*—Michael Nghiem

(57) ABSTRACT

An ink containment vessel characterized by improved resistance to the corrosive effects of ink, the ability to prevent air entry into the ink, and enhanced dimensional stability. The system also avoids the evaporative loss of volatile components from the ink supply. The ink containment vessel is produced from polyethylene naphthalate, at least one liquid crystal polymer, or polyethylene naphthalate combined with at least one liquid crystal polymer. The storage of ink within vessels made from the specialized materials listed above offers multiple benefits as previously noted and substantially improves the operational efficiency of the entire ink delivery system.

14 Claims, 2 Drawing Sheets

HIGH-DURABILITY INK CONTAINMENT UNIT FOR USE IN AN INK DELIVERY SYSTEM

BACKGROUND OF THE INVENTION

The present invention generally relates to ink printing technology, and more particularly to a specialized ink containment vessel for use in an ink delivery system which is resistant to the corrosive effects of ink, prevents air entry into the ink, avoids the evaporation of volatile ink components therefrom, and is dimensionally stable during production and thereafter. As a result, the overall longevity and operational efficiency of the entire ink delivery system is improved.

Substantial developments have been made in the field of electronic printing technology. A wide variety of highly-efficient printing systems currently exist which are capable of dispensing ink in a rapid and accurate manner. Thermal inkjet systems are especially important in this regard. Printing units using thermal inkjet technology basically involve an apparatus which includes at least one ink reservoir chamber in fluid communication with a substrate (preferably made of silicon) having a plurality of thin-film heating resistors thereon. The substrate and resistors are maintained within a structure which is conventionally characterized as a "printhead". Selective activation of the resistors causes thermal excitation of the ink materials stored inside the reservoir chamber and expulsion thereof from the printhead. Representative thermal inkjet systems are discussed in U.S. Pat. No. 4,500,895 to Buck et al.; U.S. Pat. No. 4,794,409 to Cowger et al.; U.S. Pat. No. 4,509,062 to Low et al.; U.S. Pat. No. 4,929,969 to Morris; U.S. Pat. No. 4,771,295 to Baker et al.; U.S. Pat. No. 5,278,584 to Keefe et al.; and the *Hewlett-Packard Journal*, Vol. 39, No. 4 (August 1988), all of which are incorporated herein by reference.

The ink delivery systems described above (and other printing units using different ink ejection devices) typically include an ink containment unit (e.g. a housing, vessel, or tank) having a self-contained supply of ink therein in order to form an ink cartridge. In a standard ink cartridge, the ink containment unit is directly attached to the remaining components of the cartridge to produce an integral and unitary structure wherein the ink supply is considered to be "on-board". However, in other cases, the ink containment unit will be provided at a remote location within the printer, with the containment unit being operatively connected to and in fluid communication with the printhead using one or more ink transfer conduits. These particular systems are conventionally known as "off-axis" printing units. Representative, non-limiting "off-axis" ink delivery systems are discussed in co-owned U.S. patent application Ser. No. 08/869,446 (filed on Jun. 5, 1997 and now U.S. Pat. No. 6,158,953) entitled "AN INK CONTAINMENT SYSTEM INCLUDING A PLURAL-WALLED BAG FORMED OF INNER AND OUTER FILM LAYERS" (Olsen et al.) and co-owned U.S. patent application Ser. No. 08/873,612 (filed Jun. 11, 1997and now U.S. Pat. No. 5,975,686) entitled "REGULATOR FOR A FREE-INK INKJET PEN" (Hauck et al.) which are all incorporated herein by reference. The present invention shall be applicable to both of these designs, and may likewise be used in connection with ink printing devices that employ non-thermal-inkjet technology. Accordingly, while the claimed invention shall be described herein with primary reference to thermal inkjet printing systems, it is likewise applicable to any ink delivery apparatus which employs a housing, vessel, or tank containing a supply of ink therein which has corrosive capabilities and volatile ink components.

An important consideration in the development of an ink containment unit for use with a thermal inkjet (or other type) of printing system is the ability of the containment unit to avoid substantial air introduction into the ink supply and printhead. Excessive air introduction (when reaching a critical volume) can cause a loss of system back-pressure which will typically result in operational failure of the ink ejection components and reduce overall printhead life. It is also important to prevent the evaporation of volatile components from the ink supply, with these components including water and organic solvents such as 2-pyrrolidone; 1,5-pentanediol; N-methyl pyrrolidone; 2-propanol; 2-ethyl-2-hydroxymethyl-1,3-propanediol; cyclohexanol, and others as discussed in considerable detail below. Solvent evaporation can result in a chemical deterioration of the ink supply which will reduce overall print quality and can cause premature failure of the ink delivery printhead. Accordingly, these factors must be carefully considered in any ink delivery system regardless of whether the ink containment unit (e.g. housing, vessel, or tank) is of the "on-board" variety or remotely positioned from the printhead.

Many ink cartridge units have employed rigid, thick-walled ink storage housings for containing ink therein which is present in "free flowing", unconstrained form or held within a multi-cellular foam-type member. Representative ink cartridge units which employ these types of rigid ink containment systems are illustrated in U.S. Pat. Nos. 5,185,614 and 5,168,285. Plastic is commonly used to construct the housings associated with these and other cartridge units. Representative plastic compositions which have been employed in the past for this purpose include but are not limited to polytetrafluoroethylene (Teflon®), polystyrene plastic, polyethylene terephthalate, polysulfones, and polycarbonate compositions. While these materials typically have good physical strength characteristics, they may be subject to chemical deterioration, undesired fluid permeability problems, gas transfer into and out of the ink supply, and other related conditions depending on the particular ink composition being delivered. Should any of these difficulties actually occur, they will cause operational problems in the printing system of interest (including increased "downtime", enhanced maintenance requirements, ink deterioration, and the like) as discussed above. Likewise, numerous materials are employed in traditional ink formulations which can be characterized as "corrosive" when placed in contact with plastic products (including those listed above). This "corrosion" (or, more specifically, chemical deterioration) is typically caused by the various organic solvents in the ink products which can create the problems outlined herein.

A substantial need has therefore existed for an ink containment unit applicable to both of the systems listed above (namely, self-contained and "off-axis" units) which is durable, impact-resistant, and able to (1) provide appropriate protection against ink corrosion problems; (2) present air from entering the ink supply; and (3) avoid the evaporation of volatile ink components including organic solvents and water from the ink. The present invention described below solves these problems in a unique and highly effective manner. Specifically, a novel ink containment unit (typically in the form of a housing, vessel, or tank) and ink containment method are provided which offer a solution to the problems outlined above including those involving the corrosive effects of ink materials. Furthermore, the compositions and materials discussed below which are used to produce the claimed ink containment vessels provide a considerable degree of thermal and dimensional stability during production and thereafter. In accordance with these benefits, high levels of operating efficiency, excellent print quality, and increased longevity are maintained in connection with the ink delivery systems under consideration. These and other benefits associated with the claimed invention (as well as the specific details thereof) shall be discussed in substantial detail below.

SUMMARY OF THE INVENTION

It is an object of the present invention to provide an ink delivery system of improved operating efficiency and longevity.

It is another object of the invention to provide an improved ink containment unit (also characterized herein as a "housing", "vessel", or "tank") for use in an ink delivery system which is applicable to a wide variety of different printing devices including both thermal inkjet and non-thermal-inkjet systems.

It is another object of the invention to provide an improved ink containment unit for use in an ink delivery system which employs ink supplies that are either "on-board" (e.g. directly attached to the printhead) or remotely connected to the printhead in an "off-axis" manner.

It is another object of the invention to provide an improved ink containment unit for use in an ink delivery system which is resistant to the corrosive effects of ink compositions.

It is another object of the invention to provide an improved ink containment unit for use in an ink delivery system which prevents the introduction of air into the unit so that high levels of print quality and prolonged printhead longevity can be maintained.

It is a further object of the invention to provide an improved ink containment unit for use in an ink delivery system which controls the evaporation of volatile ink components (including organic solvents and water) from the ink supply contained within the unit.

It is a further object of the invention to provide an improved ink containment unit for use in an ink delivery system which is substantially fluid-impermeable to the gases and liquids (e.g. water and/or organic solvents) that are typically associated with ink compositions.

It is a still further object of the invention to provide an improved ink containment unit for use in an ink delivery system which is thermally and dimensionally stable during production and thereafter. Specifically, the unit is not subject to undesired deformation when exposed to heat and/or the physical forces that are normally encountered during production and use.

It is a still further object of the invention to provide an improved ink containment unit for use in an ink delivery system which is durable, corrosion resistant, and capable of effective use in a wide variety of ink delivery systems.

It is an even further object of the invention to provide an improved ink containment unit for use in an ink delivery system which is readily manufactured in a cost-effective manner using mass-production techniques.

It is an even further object of the invention to provide an improved ink containment unit for use in an ink delivery system which is capable of achieving the benefits listed above in connection with many different ink compositions having multiple ingredients therein.

It is an even further object of the invention to provide an improved ink containment unit for use in an ink delivery system which is capable of being fabricated in many different shapes, sizes, capacities, and design configurations so that the unit can be employed in multiple printing systems including self-contained thermal inkjet cartridges and "off-axis"devices as previously noted.

It is an even further object of the invention to provide an ink delivery system in the form of a printhead having the claimed ink containment unit operatively connected thereto so that the foregoing benefits can be achieved.

It is an even further object of the invention to provide an effective method for preventing the introduction of air into an ink supply within an ink delivery system and controlling the evaporation of volatile ink components therefrom by retaining the ink supply inside the novel ink containment unit discussed above.

The unique ink containment system of the present invention involves a storage vessel which is made from specialized materials (designated as "barrier compositions") designed to provide improved durability, chemical-resistance, and dimensional stability. The novel features of this vessel (which may also be characterized as a "housing", "tank" or "containment unit") will now be summarized. More detailed information along with a discussion of specific construction materials and other important parameters will be provided below in the Detailed Description of Preferred Embodiments section.

In accordance with the invention, a highly effective ink containment vessel is provided for use in an ink delivery system. The term "ink delivery system" shall, without limitation, involve a wide variety of different devices including cartridge units of the "self-contained" variety having a supply of ink stored directly therein. Also encompassed within this term are printing units of the "off-axis" type which employ a printhead connected by one or more conduit members (or similar structures) to a remotely-positioned ink containment unit in the form of a tank, vessel, housing, or other equivalent structure as previously indicated. It should also be noted that the claimed ink containment vessel shall be construed to encompass any applicable cap members or "crowns" that are optionally employed to seal the system as further summarized below.

The novel ink containment vessel described herein which is made from the claimed barrier compositions shall also not be restricted to any particular sizes, shapes, capacities, or overall configurations which will be selected in accordance with the particular ink delivery system under consideration. Finally, while the present invention shall be discussed below with primary reference to systems employing thermal inkjet technology, it is likewise applicable to non-thermal-inkjet printing units (examples provided below) which include a supply of ink that can cause the previously-listed problems (e.g. corrosion, evaporation of volatile ink components, undesired fluid permeability, and the like). Thus, in its broadest sense, the invention described and claimed herein is widely applicable to a diverse group of printing systems, applications, and environments.

The claimed ink containment vessel made from the specialized chemical compositions of interest includes an internal cavity surrounded by a side wall. The side wall is optimally of unitary, single-piece construction. The particular compositions which are employed to produce the side wall of the ink containment vessel will now be discussed in detail, with the use of these materials constituting a departure from prior ink containment systems. All of these materials have a number of common attributes, namely, their ability to produce an ink containment vessel which is resistant to the corrosive effects of ink materials, is substantially fluid/gas impermeable, is dimensionally stable, and provides all of the other benefits listed above. The claimed materials are therefore related in view of their functional attributes and other important features. For this reason, they all constitute "barrier compositions" in accordance with their ability to store ink materials within the claimed vessels in a highly efficient and ink-resistant manner. In a first embodiment, the side wall of the ink containment vessel is constructed from a material designated herein as "polyethylene naphthalate" (e.g. "PEN") which is also known as a homopolymer of dimethyl 2,6-naphthalenedicarboxylate and ethylene glycol. It specifically has the following chemical structure (with either alternative being applicable):

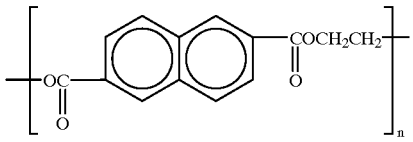

In a non-limiting preferred embodiment, n=about 10–1000 in the above-listed structure.

Regarding the chemical characteristics of this material, they involve a tensile strength of 32,000 lbs./sq. in. and a tensile modulus of 750,000 lbs./sq. in. The water vapor transmission rate of polyethylene naphthalate has been reported in the vicinity of 3.6 gm/m$^2$/day. These parameters were determined according to a standardized procedure referenced in ASTM D-882-88. Polyethylene naphthalate also has a glass transition temperature ($T_g$) of approximately 120° C. and a melting temperature of 262° C. Compared to, for example, polyethylene terephthalate ("PETE"), polyethylene naphthalate has a 43° C. higher glass transition temperature, a 50% higher tensile modulus, a 33% higher tensile strength, a five-fold improvement in its ability to function as a gas barrier (as measured in accordance with biaxially-oriented films), a three-fold improvement in hydrolysis resistance, a four-fold enhancement in moisture barrier capacity, and greater chemical resistance. In this regard, polyethylene naphthalate is highly beneficial when used to manufacture the side wall of an ink containment vessel in accordance with its considerable degree of chemical resistance to the corrosive effects of ink materials, the ability to withstand relatively high temperatures which are traditionally encountered during the manufacturing processes associated with ink containment vessel fabrication, low moisture absorption, low water vapor transmission, a high retention of tensile strength even after being exposed to hydrolysis conditions, a high continuous use temperature in an electrical environment, and the ability to be formed into many shapes in a rapid and effective manner using conventional injection molding techniques. Polyethylene naphthalate provides all of these benefits yet is economical from a material cost standpoint. Thus, the use of polyethylene naphthalate for the purposes specified herein offers many advantages and represents a significant technical advance in the art of ink containment vessel fabrication.

While polyethylene naphthalate may be obtained from a number of different sources, it is commercially available from, for example, Imperial Chemical Industries ("ICI") of Wilmington, DE (USA) under the trademark "KALADEX" and from Amoco Polymers, Inc. of Alpharetta, Ga. (USA).

At this point, it should be emphasized that the present invention and its various embodiments shall not be restricted to any particular compositions, materials, proportions, amounts, and other parameters unless otherwise stated herein. All numerical values and ranges presented below are provided for example purposes only and represent preferred embodiments of the invention designed to achieve maximum operational efficiency. Likewise the various embodiments of this invention shall not be limited to any particular construction techniques in connection with the claimed ink containment vessels and specialized barrier compositions listed herein. However, in a preferred embodiment designed for use on a mass-production scale, standard injection molding processes that are known in the art for plastic component fabrication can be employed to manufacture the claimed ink containment vessels including any applicable cap members or "crowns" associated therewith.

In a second embodiment (which shall be implemented in accordance with routine preliminary pilot testing taking into account the chemical characteristics of the ink compositions under consideration), the side wall of the ink containment vessel may be constructed from at least one or more "liquid crystal polymers". The term "liquid crystal polymer" shall be defined herein to involve a class of thermoplastic polymers that exhibit a highly ordered structure in both the melt and solid states and incorporate an aromatic backbone. In particular, liquid crystal polymers are made up entirely of aromatic monomers. The aromatic character of liquid crystal polymers as a general class contributes to the beneficial ink-resistant characteristics thereof, excellent mechanical properties, and a high degree of thermal/thermooxidative stability. The ordered character of liquid crystal polymers is likewise another distinguishing feature of these materials relative to other polymeric compounds. Accordingly, liquid crystal polymers are readily molded or fabricated more effectively in a wide variety of configurations using standard production methods. The term "aromatic" as used in this discussion shall encompass materials which contain one or more benzene ring units therein. In addition, from a structural standpoint as discussed in the *Encyclopedia of Polymer Science and Engineering* (Kroschwitz, J. ed.), Vol. 9 (entitled "Liquid Crystal Polymers to Mining Applications), John Wiley & Sons, Inc., New York (1987), pp. 1–8 (incorporated herein by reference), liquid crystal polymers shall further be defined to involve a "succession of para-oriented ring structures to give a stiff chain with a high axial ratio (ratio of length of molecule to its width, aspect ratio) x." As further stated in this reference, "The common structural feature of low molecular weight LC compounds is asymmetry of molecular shape, manifested either as rods characterized by a uniaxial order with an axial ratio usually greater than three or by thin platelets with biaxial order."

Liquid crystal polymers are particularly useful in producing the claimed ink containment vessels when ink materials are employed that are especially corrosive. The term "corrosive" shall again involve the ability of a particular chemical to dissolve or otherwise deteriorate a given material. Accordingly, the use of liquid crystal polymers to form the side wall of an ink containment vessel (particularly in thermal inkjet systems) offers many advantages and therefore constitutes another substantial advance in the art of ink delivery technology.

This embodiment of the invention shall not be restricted to any particular liquid crystal polymers or combinations thereof. Either one liquid crystal polymer or multiple liquid crystal polymers may be used in combination without limitation. Exemplary and non-limiting examples of liquid crystal polymers which can be employed for the construction of an ink containment vessel as indicated above shall involve the following commercially-available liquid crystal polymer materials:

1. A product sold under the name/trademark "Vectra" by the Hoechst Co. of Summit, N.J. (USA). From a chemical standpoint, this proprietary composition essentially consists of a wholly aromatic polyester/polyamide made from aromatic diacids, aromatic dialcohols, and aromatic moieties with two different substituents, with the substituents involving alcohols, acids, or amines. In particular, the "Vectra" line of liquid crystal polymers involves several compositions including but not limited to: (A) p-hydroxybenzoic acid modified with 2-oxynaphthalene-6-carbonyl units; or (B) 2,6-dioxynaphthalene modified with terephthaloyl units.

2. A product sold under the name/trademark "Xydar" by Amoco Polymers, Inc. of Alpharetta, Ga. (USA). Chemically, this composition basically consists of a product of the modification of p-hydrobenzoic acid with 4,4'-biphenol and terephthalic acid.

3. A product sold under the name/trademark "Zenite" by E. I. DuPont de Nemours & Company of Wilmington, Del. (USA).

Other liquid crystal polymers which may be employed include but are not limited to the following materials: aromatic polyamides, aromatic polyoxamides, aromatic polyhydrazides, aromatic poly(oxalic hydrazides), aromatic poly(amine hydrazides), poly(p-phenylenebenzobisthiazole), and polyimides.

Notwithstanding the materials listed above, the present invention shall not be restricted to any particular liquid crystal polymers or mixtures thereof with many commercial compositions suitable for this purpose being applicable. A number of these materials are proprietary in nature, yet fall within the basic definition listed above and also provide the foregoing benefits.

Finally, in a third embodiment, the novel ink containment vessels of the present invention may be constructed from polyethylene naphthalate in combination with at least one or more liquid crystal polymers as defined above to form a polyethylene naphthalate/liquid crystal polymer "blend". All of the information, parameters, examples, commercial sources, and other data presented above regarding polyethylene naphthalate and liquid crystal polymers as employed in the first and second embodiments shall be equally applicable to and incorporated by reference in this embodiment. The use of at least one liquid crystal polymer in combination with polyethylene naphthalate is designed to further enhance the beneficial characteristics discussed above (including improved chemical resistance to ink materials and the control of gas/liquid permeability problems). In particular, blends involving polyethylene naphthalate and at least one liquid crystal polymer in combination enable the best features of both compositions to be employed in a single mixed compound. Thus, by using a blend of both materials, the resulting product (from a chemical composition standpoint) can be appropriately "adjusted" as needed to properly tailor the ink containment vessel to the type of ink composition under consideration. In other words, by selectively controlling the amount of each material in the chosen blend, the desired characteristics to be imparted to the ink containment vessel can be accurately selected in accordance with preliminary pilot studies on the ink compositions being delivered. Thus, the use of at least one liquid crystal polymer in combination with polyethylene naphthalate to produce the side wall of an ink containment vessel provides an even further advance in the art of ink delivery technology. Both of these materials in combination produce unexpectedly superior results as indicated above.

In accordance with the present embodiment which again involves a combination of (1) polyethylene naphthalate; and (2) at least one or more liquid crystal polymers, the invention shall not be restricted to any particular numerical proportions. However, in a representative example designed to provide optimum results, the side wall of the selected ink containment vessel will contain about 10–50% by weight polyethylene naphthalate and about 50–90% by weight total liquid crystal polymer (whether a single material is used or multiple polymers are employed in combination, with the range listed above involving the total amount of liquid crystal polymers included in the combination). Any determination regarding the proportions of polyethylene naphthalate and liquid crystal polymers in this embodiment shall be undertaken in accordance with routine preliminary testing taking into account the ink materials under consideration and their chemical characteristics.

Regarding the construction of an ink delivery system which incorporates the claimed compositions and ink containment vessels, many different systems (both thermal inkjet and non-thermal-inkjet) may be employed for this purpose including those described in the foregoing issued U.S. patents. A representative and preferred apparatus will comprise a printhead having at least one ink ejector for expelling ink on demand from the printhead and an ink containment vessel operatively connected to and in fluid communication with the printhead. The novel ink containment vessel will again include an internal cavity therein surrounded by a side wall which is used to retain an ink supply within the vessel. The side wall (which is specifically designed to prevent air and volatile ink components from passing therethrough along with the other benefits listed above) is constructed from the specialized barrier compositions listed above. These materials again include: (1) polyethylene naphthalate; (2) at least one liquid crystal polymer; or (3) polyethylene naphthalate in combination with at least one or more liquid crystal polymers to form a "blend" as previously defined. Furthermore, the term "operatively connected" which is used to specify the interrelationship between the printhead and the ink containment vessel shall be broadly construed to encompass: (A) a system in which the ink containment vessel is directly attached to and in fluid communication with the printhead to form, for example, a single cartridge unit having an "on-board" ink supply; and (B) an "off-axis" system as previously discussed in which the ink containment vessel is remotely spaced from the printhead and not "directly" attached thereto. In system (B), the ink containment vessel is preferably in fluid communication with the printhead using at least one ink transfer conduit connected to and between the printhead and the vessel. Both of these systems shall be applicable to all of the various embodiments of the claimed ink containment unit and methods for ink preservation.

The present invention shall likewise encompass a general method for preventing the evaporation and leakage of volatile ink components (e.g. organic solvents and/or water) from an ink delivery system having a supply of ink therein. The claimed method also avoids the introduction of air into the ink supply and improves the overall chemical-resistance of the system. These goals are accomplished by: (1) providing an ink delivery system of the type discussed above which includes a printhead having at least one ink ejector for expelling ink on demand from the printhead; and (2) storing a supply of ink within an ink containment vessel operatively connected to and in fluid communication with the printhead wherein the ink containment vessel includes a side wall which prevents air and volatile ink components from passing therethrough. The side wall is again constructed from the following barrier compositions: [A] polyethylene naphthalate; [B] at least one or more liquid crystal polymers; or [C] polyethylene naphthalate in combination with at least one or more liquid crystal polymers to form a "blend". Accordingly, all of the information presented above regarding representative ink delivery systems, ink containment units, and preferred barrier compositions is incorporated by reference relative to the claimed method(s). These methods shall not be limited to any specific materials, construction methods, component arrangements, or other parameters unless otherwise noted herein.

The present invention represents a significant advance in the art of ink printing technology and the generation of high-quality images. The structures, components, and methods outlined in detail below provide many important benefits including (1) resistance to the corrosive effects of ink materials; (2) the prevention of air introduction into the ink supply contained within the printing system; (3) the avoidance of evaporative ink losses; and (4) the ability to prevent fluid leakage from the ink supply. In addition, containment vessels produced from the claimed compositions are dimensionally stable during and after production notwithstanding the application of heat and/or physical force to the vessels. As a result, high levels of operating efficiency, print quality, and longevity are maintained in connection with the ink delivery system. These and other benefits, objects, features, and advantages will now be discussed in the following Brief Description of the Drawings and Detailed Description of Preferred Embodiments.

BRIEF DESCRIPTION OF THE DRAWINGS

Any reference numbers carried over from one drawing figure to other drawing figures shall constitute common subject matter applicable to all of the drawing figures under consideration. Likewise, the drawing figures presented herewith are shown in enlarged schematic format for illustrative purposes.

DETAILED DESCRIPTION OF PREFERRED EMBODIMENTS

Figure 1:
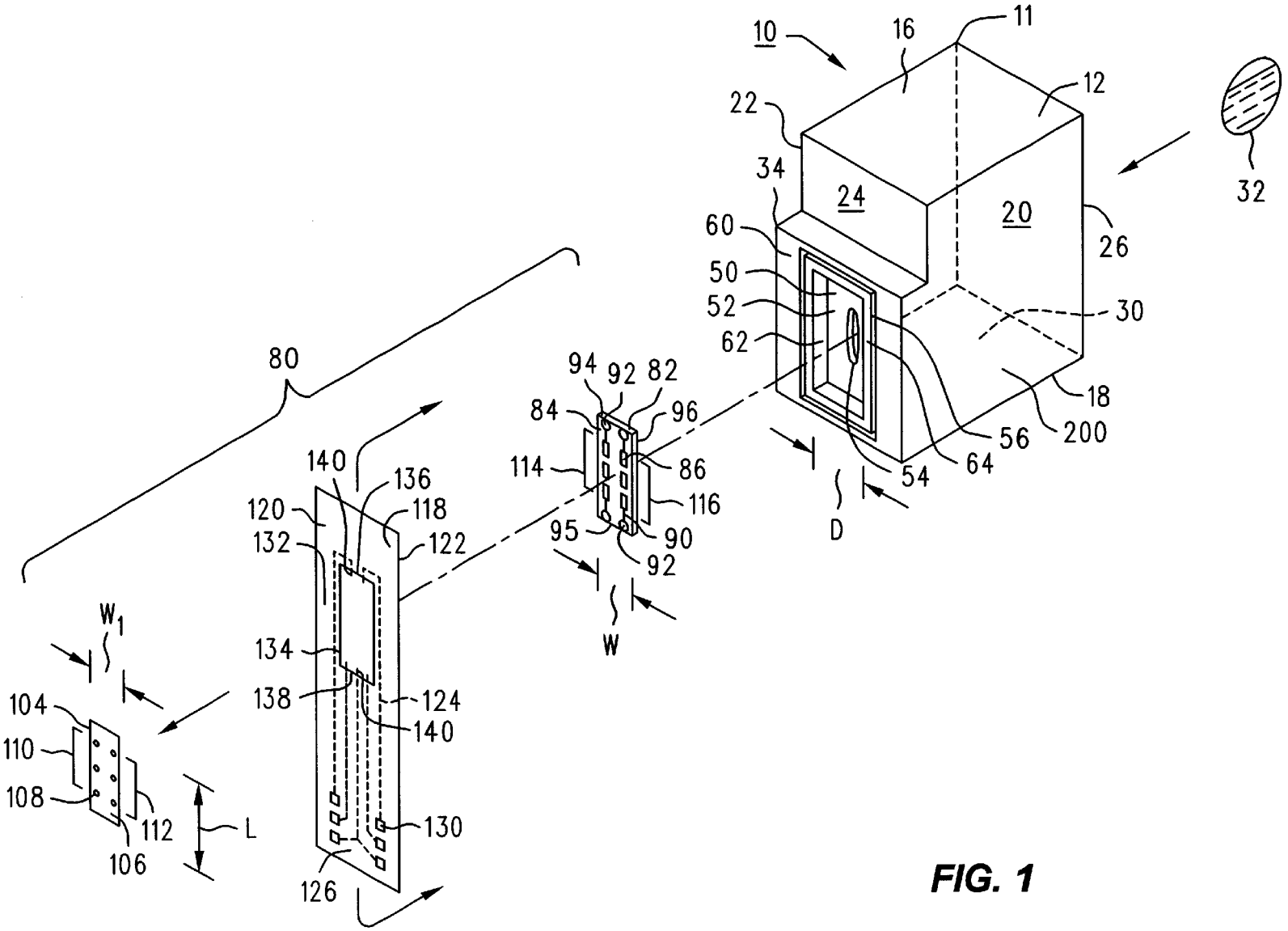
FIG. 1 is a schematically-illustrated, exploded perspective view of a representative ink delivery system in the form of an ink cartridge which is suitable for use with the components and methods of the present invention. The ink cartridge of FIG. 1 has an ink containment vessel directly attached to the cartridge so that an "on-board" ink supply is provided.

The present invention involves a high-durability ink containment unit in the form of a vessel, housing, or tank for use in an ink delivery system including those which employ thermal inkjet technology. For the sake of convenience, the term "ink containment vessel" will be used hereinafter with the understanding that it is synonymous with all of the other terms listed above. The novel ink containment vessel is produced from highly-specialized chemical compounds which are not subject to chemical deterioration caused by the corrosive effects of ink materials. Likewise, the chemical compositions described herein substantially prevent the passage of air therethrough (and into the ink supply of interest) while simultaneously controlling the escape of volatile ink components including organic solvents and water. In this manner, the longevity of the entire printing system is extended along with the maintenance of high print quality levels. Furthermore, the claimed ink containment vessels are fluid-impermeable and dimensionally stable during production and thereafter when exposed to heat and/or physical force. The term "dimensionally stable" shall involve a situation where the ink containment vessel does not experience undesired deformation when heated and/or exposed to physical forces normally encountered during production and use. While the present invention shall be described below with primary reference to thermal inkjet technology, many different ink delivery systems may be employed with equivalent results provided that the selected systems include a printhead having at least one ink ejector associated with the printhead. The term "ink ejector" shall involve any component, device, element, or structure which may be used to expel ink on-demand from the printhead. For example, in a thermal inkjet printing system, "ink ejector" will encompass the use of one or more selectively-energizable thin-film heating resistors as outlined in greater detail below. In this regard, the materials, methods, and structures of the invention are not "system-specific" which will become readily apparent from the detailed discussion presented herein. To provide a clear and complete understanding of the invention, the following description will be divided into three sections, namely, (1) "A. A General Overview of Thermal Inkjet Technology and Ink Compositions Associated Therewith"; (2) "B. The Novel Ink Containment Vessels"; and (3) "C. Additional Information and Methods of Use."

A. A General Overview of Thermal Inkjet Technology and Ink Compositions Associated Therewith The present invention is again applicable to a wide variety of ink cartridge systems which include (1) a printhead; (2) at least one "ink ejector" associated with the printhead; and (3) an ink containment vessel of the type described herein which is operatively connected to and in fluid communication with the printhead. The ink containment vessel may be directly attached to the printhead or remotely connected thereto in an "off-axis" system using one or more ink transfer conduits. The phrase "operatively connected" as it applies to the printhead and ink containment vessel shall encompass both of these variants and equivalent structures. As previously stated, the term "ink ejector" is defined to involve any component, system, or device which selectively ejects or expels ink on-demand from the printhead. Thermal inkjet cartridges which use multiple heating resistors as ink ejectors are preferred for this purpose. However, the claimed invention shall not be restricted to any particular ink ejectors or ink printing technologies. A wide variety of different ink delivery devices may be encompassed within the invention including but not limited to piezoelectric drop systems of the general type disclosed in U.S. Pat. No. 4,329,698 to Smith, dot matrix devices of the variety described in U.S. Pat. No. 4,749,291 to Kobayashi et al., as well as other comparable and functionally equivalent systems designed to deliver ink using one or more ink ejectors. The specific operating components associated with these alternative systems (e.g. the piezoelectric elements in the system of U.S. Pat. No. 4,329,698) shall be encompassed within the term "ink ejectors" as previously defined.

To facilitate a complete understanding of the claimed components and methods as they apply to thermal inkjet technology (which is the preferred system of primary interest), an overview of thermal inkjet technology will now be provided. A representative ink delivery system in the form of a thermal inkjet cartridge unit is illustrated in FIG. 1 at reference number 10. It shall be understood that cartridge 10 is presented herein for example purposes and is non-limiting. Cartridge 10 is shown in schematic format in FIG. 1, with more detailed information regarding cartridge 10 and its various features (as well as similar systems) being provided in U.S. Pat. No. 4,500,895 to Buck et al.; U.S. Pat. No. 4,794,409 to Cowger et al.; U.S. Pat. No. 4,509,062 to Low et al.; U.S. Pat. No. 4,929,969 to Morris; U.S. Pat. No. 4,771,295 to Baker et al.; U.S. Pat. No. 5,278,584 to Keefe et al.; and the *Hewlett-Packard Journal,* Vol. 39, No. 4 (August 1988), all of which are incorporated herein by reference.

With continued reference to FIG. 1, the cartridge 10 first includes an ink containment vessel 11 in the form of a housing 12 which is manufactured from the specialized barrier compositions discussed below. As noted above, the housing 12 shall constitute the ink containment unit of the invention, with the terms "ink containment unit", "housing", "vessel", and "tank" all being considered equivalent from a functional and structural standpoint. The housing 12 further comprises a top wall 16, a bottom wall 18, a first side panel 20, and a second side panel 22. In the embodiment of FIG. 1, the top wall 16 and the bottom wall 18 are substantially parallel to each other. Likewise, the first side panel 20 and the second side panel 22 are also substantially parallel to each other.

The housing 12 additionally includes a front wall 24 and a rear wall 26 which is optimally parallel to the front wall 24 as illustrated. Surrounded by the front wall 24, rear wall 26, top wall 16, bottom wall 18, first side panel 20, and second side panel 22 is an interior chamber or compartment 30 within the housing 12 (shown in phantom lines in FIG. 1) which is designed to retain a supply of an ink composition 32 therein that is either in unconstrained (e.g. "free-flowing") form or retained within a multicellular foam-type structure.

The front wall 24 also includes an externally-positioned, outwardly-extending printhead support structure 34 which comprises a substantially rectangular central cavity 50. The central cavity 50 includes a bottom wall 52 shown in FIG. 1 with an ink outlet port 54 therein. The ink outlet port 54 passes entirely through the housing 12 and, as a result, communicates with the compartment 30 inside the housing 12 so that ink materials can flow outwardly from the compartment 30 through the ink outlet port 54. Also positioned within the central cavity 50 is a rectangular, upwardly-extending mounting frame 56, the function of which will be discussed below. As schematically shown in FIG. 1, the mounting frame 56 is substantially even (flush) with the front face 60 of the printhead support structure 34. The mounting frame 56 specifically includes dual, elongate side walls 62, 64.

With continued reference to FIG. 1, fixedly secured to housing 12 of the ink cartridge 10 (e.g. attached to the outwardly-extending printhead support structure 34) is a printhead generally designated in FIG. 1 at reference number 80. For the purposes of this invention and in accordance with conventional terminology, the printhead 80 actually comprises two main components fixedly secured together (with certain sub-components positioned therebetween). The first main component used to produce the printhead 80 consists of a substrate 82 preferably manufactured from silicon. Secured to the upper surface 84 of the substrate 82 using standard thin film fabrication techniques is a plurality of individually-energizable thin-film resistors 86 which function as "ink ejectors" and are preferably fabricated from a tantalum-aluminum composition known in the art for resistor construction. Only a small number of resistors 86 are shown in the schematic representation of FIG. 1, with the resistors 86 being presented in enlarged format for the sake of clarity. Also provided on the upper surface 84 of the substrate 82 using conventional photolithographic techniques is a plurality of metallic conductive traces 90 (e.g. circuit elements) which electrically communicate with the resistors 86. The conductive traces 90 likewise communicate with multiple metallic pad-like contact regions 92 positioned at the ends 94, 95 of the substrate 82 on the upper surface 84. The function of all these components which, in combination, are collectively designated herein as a "resistor assembly" 96 will be summarized further below.

Many different materials and design configurations may be used to construct the resistor assembly 96, with the present invention not being restricted to any particular elements, materials, and components for this purpose. However, in a preferred, representative, and non-limiting embodiment, the resistor assembly 96 will be approximately 0.5 inches long, and will likewise contain 300 resistors 86 thus enabling a resolution of 600 dots per inch ("DPI"). The substrate 82 containing the resistors 86 thereon will preferably have a width "W" (FIG. 1) which is less than the distance "D" between the side walls 62, 64 of the mounting frame 56. As a result, ink flow passageways are formed on both sides of the substrate 82 so that ink flowing from the ink outlet port 54 in the central cavity 50 can ultimately come in contact with the resistors 86. It should also be noted that the substrate 82 may include a number of other components thereon (not shown) depending on the type of ink cartridge 10 under consideration. For example, the substrate 82 may likewise comprise a plurality of logic transistors for precisely controlling operation of the resistors 86, as well as a "demultiplexer" of conventional configuration as discussed in U.S. Pat. No. 5,278,584. The demultiplexer is used to demultiplex incoming multiplexed signals and thereafter distribute these signals to the various thin film resistors 86. The use of a demultiplexer for this purpose enables a reduction in the complexity and quantity of the circuitry (e.g. contact regions 92 and traces 90) formed on the substrate 82.

Securely affixed to the upper surface 84 of the substrate 82 (with a number of intervening material layers therebetween including an ink barrier layer) is the second main component of the printhead 80. Specifically, an orifice plate 104 is provided as shown in FIG. 1 which is used to distribute the selected ink compositions to a designated print media material (e.g. paper). In accordance with the claimed invention, the orifice plate 104 consists of a panel member 106 (illustrated schematically in FIG. 1) which is manufactured from one or more metal compositions (e.g. gold-plated nickel [Ni] and the like). In a typical and non-limiting representative embodiment, the orifice plate 104 will have a length "L" of about 5–30 mm and a width "$W_1$" of about 3–15 mm. However, the claimed invention shall not be restricted to any particular orifice plate parameters unless otherwise indicated herein.

The orifice plate 104 further comprises at least one and preferably a plurality of openings or "orifices" therethrough which are designated at reference number 108. These orifices 108 are shown in enlarged format in FIG. 1. Each orifice 108 in a representative embodiment will have a diameter of about 0.01–0.05 mm. In the completed printhead 80, all of the components listed above are assembled so that each of the orifices 108 is aligned with at least one of the resistors 86 (e.g. "ink ejectors") on the substrate 82. As result, energization of a given resistor 86 will cause ink expulsion from the desired orifice 108 through the orifice plate 104. The claimed invention shall not be limited to any particular size, shape, or dimensional characteristics in connection with the orifice plate 104 and shall likewise not be restricted to any number or arrangement of orifices 108. In an exemplary embodiment as presented in FIG. 1, the orifices 108 are arranged in two rows 110, 112 on the panel member 106 associated with the orifice plate 104. If this arrangement of orifices 108 is employed, the resistors 86 on the resistor assembly 96 (e.g. the substrate 82) will also be arranged in two corresponding rows 114, 116 so that the rows 114, 116 of resistors 86 are in substantial registry with the rows 110, 112 of orifices 108. Further general information concerning this type of metallic orifice plate system is provided in, for example, U.S. Pat. No. 4,500,895 to Buck et al. which is incorporated herein by reference.

It should also be noted for background purposes that, in addition to the systems discussed above which involve metal orifice plates, alternative printing units have effectively employed orifice plate structures constructed from non-metallic organic polymer compositions. These structures typically have a representative and non-limiting thickness of about 1.0–2.0 mils. In this context, the term "non-metallic" will encompass a product which does not contain any elemental metals, metal alloys, or metal amalgams. The phrase "organic polymer" shall involve a long-chain carbon-containing structure of repeating chemical subunits. A number of different polymeric compositions may be employed for this purpose. For example, non-metallic orifice plate members may be manufactured from the following compositions: polytetrafluoroethylene (e.g. Teflon®), polyimide, polymethylmethacrylate, polycarbonate, polyester, polyamide, polyethylene terephthalate, or mixtures thereof. Likewise, a representative commercial organic polymer (e.g. polyimide-based) composition which is suitable for constructing a non-metallic organic polymer-based orifice plate member in a thermal inkjet printing system is a product sold under the trademark "KAPTON" by E. I. du Pont de Nemours & Company of Wilmington, Del. (USA). Further data regarding the use of non-metallic organic orifice plate systems is provided in U.S. Pat. No. 5,278,584 (incorporated herein by reference).

With continued reference to FIG. 1, a film-type flexible circuit member 118 is likewise provided in connection with the cartridge 10 which is designed to "wrap around" the outwardly-extending printhead support structure 34 in the completed ink cartridge 10. Many different materials may be used to produce the circuit member 118, with representative (non-limiting) examples including polytetrafluoroethylene (e.g. Teflon®), polyimide, polymethylmethacrylate, polycarbonate, polyester, polyamide, polyethylene terephthalate, or mixtures thereof. Likewise, a representative commercial organic polymer (e.g. polyimide-based) composition which is suitable for constructing the flexible circuit member 118 is a product sold under the trademark "KAPTON" by E. I. du Pont de Nemours & Company of Wilmington, Del. (USA) as previously noted. The flexible circuit member 118 is secured to the printhead support structure 34 by adhesive affixation using conventional adhesive materials (e.g. epoxy resin compositions known in the art for this purpose). The flexible circuit member 118 enables electrical signals to be delivered and transmitted from the printer unit (not shown) to the resistors 86 (or other ink ejectors) on the substrate 82 as discussed below. The film-type flexible circuit member 118 further includes a top surface 120 and a bottom surface 122 (FIG. 1). Formed on the bottom surface 122 of the circuit member 118 and shown in dashed lines in FIG. 1 is a plurality of metallic (e.g. gold-plated copper) circuit traces 124 which are applied to the bottom surface 122 using known metal deposition and photolithographic techniques. Many different circuit trace patterns may be employed on the bottom surface 122 of the flexible circuit member 118, with the specific pattern depending on the particular type of ink cartridge 10 and printing system under consideration. Also provided at position 126 on the top surface 120 of the circuit member 118 is a plurality of metallic (e.g. gold-plated copper) contact pads 130. The contact pads 130 communicate with the underlying circuit traces 124 on the bottom surface 122 of the circuit member 118 via openings or "vias" (not shown) through the circuit member 118. During use of the ink cartridge 10 in a printer unit, the pads 130 come in contact with corresponding printer electrodes in order to transmit electrical control signals from the printer unit to the contact pads 130 and traces 124 on the circuit member 118 for ultimate delivery to the resistor assembly 96. Electrical communication between the resistor assembly 96 and the flexible circuit member 118 will again be outlined below.

Positioned within the middle region 132 of the film-type flexible circuit member 118 is a window 134 which is sized to receive the orifice plate 104 therein. As shown schematically in FIG. 1, the window 134 includes an upper longitudinal edge 136 and a lower longitudinal edge 138. Partially positioned within the window 134 at the upper and lower longitudinal edges 136, 138 are beam-type leads 140 which, in a representative embodiment, are gold-plated copper and constitute the terminal ends (e.g. the ends opposite the contact pads 130) of the circuit traces 124 positioned on the bottom surface 122 of the flexible circuit member 118. The leads 140 are designed for electrical connection by soldering, thermocompression bonding, and the like to the contact regions 92 on the upper surface 84 of the substrate 82 associated with the resistor assembly 96. As a result, electrical communication is established from the contact pads 130 to the resistor assembly 96 via the circuit traces 124 on the flexible circuit member 118. Electrical signals from the printer unit (not shown) can then travel via the conductive traces 90 on the substrate 82 to the resistors 86 so that on-demand heating (energization) of the resistors 86 can occur.

It is important to emphasize that the present invention shall not be restricted to the specific printhead 80 illustrated in FIG. 1 and discussed above, with many other printhead designs also being suitable for use in accordance with the invention. The printhead 80 of FIG. 1 is provided for example purposes and shall not limit the invention in any respect. Likewise, it should also be noted that if a non-metallic organic polymer-type orifice plate system is desired, the orifice plate 104 and flexible circuit member 118 can be manufactured as a single unit as discussed in U.S. Pat. No. 5,278,584.

The last major step in producing the completed printhead 80 involves physical attachment of the orifice plate 104 in position on the underlying portions of the printhead 80 so that the orifices 108 are in precise alignment with the resistors 86 on the substrate 82 as previously noted. Attachment of these components together may likewise be accomplished through the use of conventional adhesive materials (e.g. epoxy and/or cyanoacrylate adhesives known in the art for this purpose).

As a final note regarding ink cartridge 10, the rear wall 26 shown in FIG. 1 may involve a separately-produced structure in the form of a cap member or "crown" that is affixed in position to the other portions of the housing 12 by conventional thermal welding process or the use of adhesives (e.g. standard epoxy resins or cyanoacrylate materials). In accordance with the inventive concepts disclosed herein, the terms "ink containment unit", "housing", "vessel", "tank", and the like shall be construed (if desired and appropriate) to likewise encompass any cap members or "crowns" that are optionally employed to seal the system.

The ink cartridge 10 discussed above in connection with FIG. 1 involves a "self-contained" ink delivery system which includes an "on-board" supply of ink. The claimed invention may likewise be used with other systems (both thermal inkjet and non-thermal-inkjet) which employ a printhead and a supply of ink stored within an ink containment vessel that is remotely spaced but operatively connected to and in fluid communication with the printhead. Fluid communication is accomplished using one or more tubular conduits. An example of such a system is disclosed in co-owned U.S. patent application Ser. No. 08/869,446 (filed on Jun. 5, 1997 and now U.S. Pat. No. 6,158,853) entitled "AN INK CONTAINMENT SYSTEM INCLUDING A PLURAL-WALLED BAG FORMED OF INNER AND OUTER FILM LAYERS" (Olsen et al.) and co-owned U.S. patent application Ser. No. 08/873,612 (filed Jun. 11, 1997 and now U.S. Pat. No. 5,975,686) entitled "REGULATOR FOR A FREE-INK INKJET PEN" (Hauck et al.) which are all incorporated herein by reference. This type of "remote" system (which is basically known as an "off-axis" unit) involves a tank-like housing containing a supply of ink therein that is operatively connected to and in fluid communication with a printhead containing at least one ink ejector as defined above. Representative ink ejectors include the resistor units employed in thermal inkjet systems and other devices (e.g. piezoelectric elements and the like). Accordingly, the main difference between an "off-axis" system and the apparatus FIG. 1 is the proximity and orientation of the ink containment vessel relative to the printhead.

Figure 2:
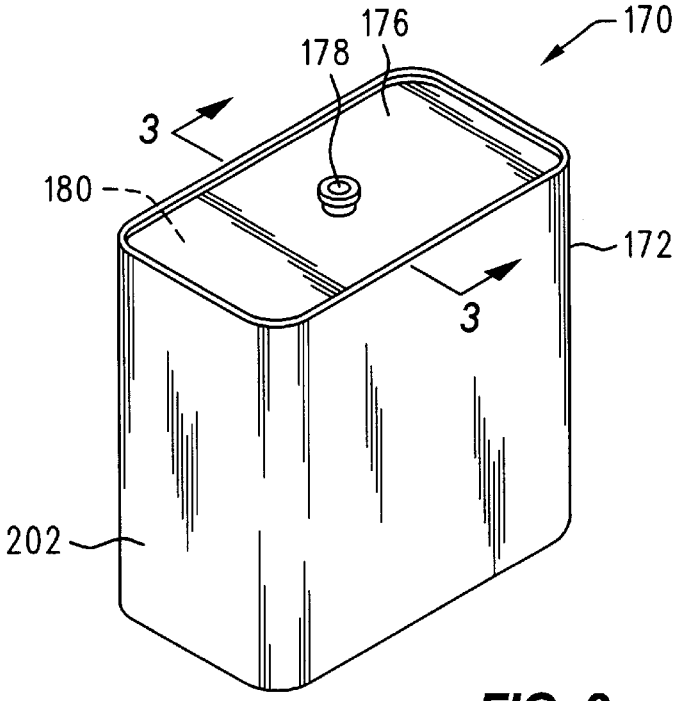
FIG. 2 is a schematically-illustrated perspective view of an alternative ink containment vessel which may be constructed from the specialized barrier compositions described herein.
Figure 3:
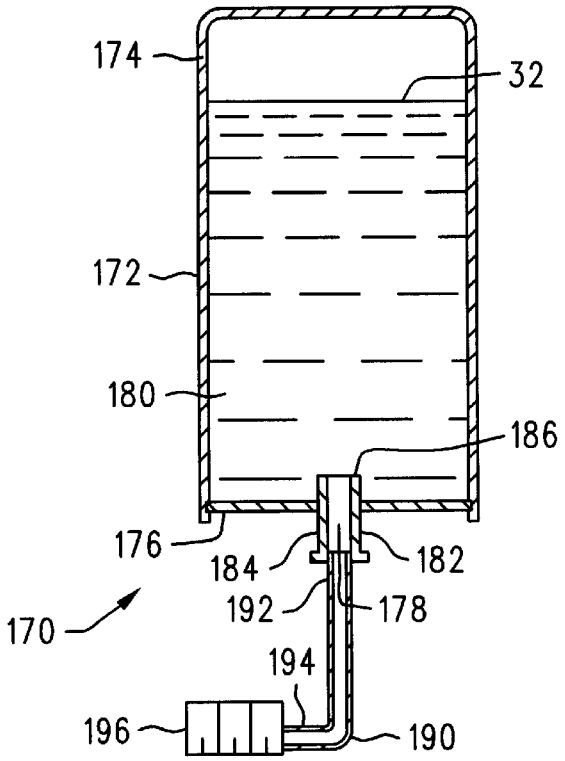
FIG. 3 is a partial cross-sectional view of the ink containment vessel shown in FIG. 2 taken along lines 3—3 which is operatively connected to a printhead using at least one ink transfer conduit in an "off-axis" system.

With reference to FIGS. 2–3, an alternative ink delivery system is shown which includes a tank-like ink containment vessel 170 that is designed for remote operative connection (preferably on a gravity feed or other comparable basis) to a selected printhead. Again, the terms "ink containment unit", "vessel", "housing", and "tank" shall be considered equivalent in this case. The printhead may be of a thermal inkjet type or other variety as previously noted. The ink containment vessel 170 is configured in the form of an outer shell or housing 172 which includes a main body portion 174 and a top panel member 176 having an inlet/outlet port 178 passing therethrough (FIG. 3). While this embodiment shall not be restricted to any particular assembly methods in connection with the housing 172, the top panel member 176 is optimally produced as a separate structure from the main body portion 174. The top panel member 176 is thereafter secured to the main body portion 174 as illustrated in FIG. 3 using known thermal welding processes or conventional adhesives (e.g. epoxy resin or cyanoacrylate compounds). However, the top panel member 176 shall, in a preferred embodiment, be considered part of the overall ink containment vessel 170/housing 172.

With continued reference to FIG. 3, the housing 172 also has an internal chamber or cavity 180 therein for storing a supply of an ink composition 32. In addition, the housing 172 further includes an outwardly-extending tubular member 182 which passes through the top panel member 176 and, in a preferred embodiment, is integrally formed therein. The term "tubular" as used throughout this description shall be defined to encompass a structure which includes at least one or more central passageways therethrough that are surrounded by an outer wall. The tubular member 182 incorporates the inlet/outlet port 178 therein as illustrated in FIG. 3 which provides access to the internal cavity 180 inside the housing 172.

The tubular member 182 positioned within the top panel member 176 of the housing 172 has an outer section 184 which is located outside of the housing 172 and an inner section 186 that is located within the ink composition 32 in the internal cavity 180 (FIG. 3.) The outer section 184 of the tubular member 182 is operatively attached by adhesive materials (e.g. conventional cyanoacrylate or epoxy compounds), frictional engagement, and the like to a tubular ink transfer conduit 190 positioned within the port 178 shown schematically in FIG. 3. In the embodiment of FIG. 3, the ink transfer conduit 190 includes a first end 192 which is attached using the methods listed above to and within the port 178 in the outer section 184 of the tubular member 182. The ink transfer conduit 190 further includes a second end 194 that is operatively and remotely attached to a printhead 196 which may involve a number of different designs, configurations, and systems including those associated with printhead 80 illustrated in FIG. 1. All of these components are appropriately mounted within a selected printer unit at predesignated locations therein, depending on the type, size, and overall configuration of the entire ink delivery system. It should also be noted that the ink transfer conduit 190 may include at least one optional in-line pump of conventional design (not shown) for facilitating the transfer of ink.

The systems and components presented in FIGS. 2–3 are illustrative in nature. They may, in fact, include additional operating components depending on the particular systems under consideration. The information provided above shall not limit or restrict the present invention and its various embodiments. Instead, the embodiment of FIGS. 2–3 may be varied as needed and is presented entirely to demonstrate the applicability of the claimed invention to ink delivery systems which employ a remotely located ink containment vessel.

Many different ink formulations may be employed without limitation as the ink composition 32 in the claimed ink delivery systems. Likewise, the term "ink" as used herein shall encompass dye-based materials, pigment dispersions, and liquid-toner products. However, the present invention is especially suitable for use with ink materials that contain volatile components (e.g. organic solvents and water) and compounds that are "corrosive" when placed in contact with traditional plastics. Representative corrosive materials include acidic dyes, organic solvents, and the like. The term "corrosive" shall again involve the ability of a particular chemical to dissolve or otherwise deteriorate a given material. Some representative and non-limiting ink formulations will now be discussed in detail which may be employed in connection with the ink composition 32.

The ink products of interest will first contain at least one coloring agent. The coloring agents may include one or more colored dyes or achromatic (black or white) dyes. For example, representative black dyes that are suitable for use in the ink compositions are listed in U.S. Pat. No. 4,963,189 to Hindagolla which is incorporated herein by reference. Colored dyes which may be employed are described in the *Color Index,* Vol. 4, 3rd ed., published by The Society of Dyers and Colourists, Yorkshire, England (1971) which is incorporated herein by reference and is a standard text that is well known in the art. Exemplary dye materials listed in the *Color Index,* supra, that are suitable for use herein include but are not limited to the following compositions: C.I. Direct Yellow 11, C.I. Direct Yellow 86, C.I. Direct Yellow 132, C.I. Direct Yellow 142, C.I. Direct Red 9, C.I. Direct Red 24, C.I. Direct Red 227, C.I. Direct Red 239, C.I. Direct Blue 9, C.I. Direct Blue 86, C.I. Direct Blue 189, C.I. Direct Blue 199, C.I. Direct Black 19, C.I. Direct Black 22, C.I. Direct Black 51, C.I. Direct Black 163, C.I. Direct Black 169, C.I. Acid Yellow 3, C.I. Acid Yellow 17, C.I. Acid Yellow 23, C.I. Acid Yellow 73, C.I. Acid Red 18, C.I. Acid Red 33, C.I. Acid Red 52, C.I. Acid Red 289, C.I. Acid Blue 9, C.I. Acid Blue 61: 1, C.I. Acid Blue 72, C.I. Acid Black 1, C.I. Acid Black 2, C.I. Acid Black 194, C.I. Reactive Yellow 58, C.I. Reactive Yellow 162, C.I. Reactive Yellow 163, C.I. Reactive Red 21, C.I. Reactive Red 159, C.I. Reactive Red 180, C.I. Reactive Blue 79, C.I. Reactive Blue 216, C.I. Reactive Blue 227, C.I. Reactive Black 5, C.I. Reactive Black 31, C.I. Basic Yellow 13, C.I. Basic Yellow 60, C.I. Basic Yellow 82, C.I. Basic Blue 124, C.I. Basic Blue 140, C.I. Basic Blue 154, C.I. Basic Red 14, C.I. Basic Red 46, C.I. Basic Red 51, C.I. Basic Black 11, and mixtures thereof. These materials are known in the art and commercially available from a variety of sources including but not limited to the Sandoz Corporation of East Hanover, N.J. (USA), Ciba-Geigy of Ardsley, N.Y. (USA), and others.

The term "coloring agent" shall likewise encompass conventional pigment dispersions which basically involve a water-insoluble colorant (e.g. a pigment) which is rendered soluble through association with a dispersant (e.g. an acrylic dispersant). Specific pigments which may be employed to produce pigment dispersion materials are known in the art, and the present invention shall not be limited to any particular chemical compositions in this regard. Examples of such pigments include the following compounds which are listed in the *Color Index,* supra: C.I. Pigment Black 7, C.I. Pigment Blue 15, and C.I. Pigment Red 2. Dispersant materials suitable for combination with these and other pigments include monomers and polymers known in the art for this purpose. An exemplary commercial dispersant involves a product sold by W. R. Grace and Co. of Lexington, Mass. (USA) under the trademark DAXAD. In a preferred embodiment, the ink compositions of interest will contain about 2–7% by weight total coloring agent therein (e.g. whether a single coloring agent or combined coloring agents are used). However, the amount of coloring agent to be employed may be varied as needed, depending on the ultimate purpose for which the ink composition is intended and the other ingredients in the ink.

The ink composition will also include an ink "vehicle" which essentially functions as a carrier medium and main solvent for the other components in the composition. Many different materials may be used as the ink vehicle, with the present invention not being limited to any particular products for this purpose. A preferred ink vehicle will consist of water combined with other ingredients including organic solvents. These organic solvents include but are not limited to 2-pyrrolidone; ethoxylated glycerol; 1,5-pentanediol; N-methyl pyrrolidone; 2-propanol; 2-ethyl-2-hydroxymethyl-1,3-propanediol; and cyclohexanol. Such materials are volatile in character and can be lost by evaporation. If this situation occurs, the ink compositions may experience changes in viscosity, homogeneity, and color character which will typically cause a substantial deterioration in print quality. All of these materials may be used in various combinations as determined by preliminary pilot studies on the ink formulations of concern. However, in a preferred embodiment, the ink compositions will contain about 70–80% by weight total combined ink vehicle, wherein at least about 30% by weight of the total ink vehicle will typically consist of water (with the balance comprising any one of the above-listed organic solvents alone or combined). An exemplary ink vehicle will contain about 60–80% by weight water and about 10–30% by weight of one or more organic solvents.

The ink materials may also include a number of optional ingredients in varying amounts. For example, an optional biocide may be added to prevent any microbial growth in the final ink product. Exemplary biocides suitable for this purpose include proprietary products sold under the trademarks PROXEL GXL by Imperial Chemical Industries of Manchester, England; UCARCID by Union Carbide of Danbury, Conn. (USA); and NUOSEPT by Huls America, Inc. of Piscataway, N.J. (USA). In a preferred embodiment, if a biocide is used, the final ink composition will typically include about 0.05–0.5% by weight biocide, with about 0.30% by weight being preferred.

Another optional ingredient to be used in the ink compositions will involve one or more buffering agents. The use of a selected buffering agent or multiple (combined) buffering agents is designed to stabilize the pH of the ink compositions. In a preferred embodiment, the desired pH of the ink compositions will range from about 4–9. Exemplary buffering agents suitable for this purpose will comprise sodium borate, boric acid, and phosphate buffering materials known in the art for pH control. The selection of any particular buffering agents and the amount of buffering agents to be used (as well as the decision to use buffering agents in general) will be determined in accordance with preliminary pilot studies on the particular ink compositions of concern. Additional ingredients (e.g. surfactants) may also be present in the ink formulations if needed.

The novel ink containment vessels described herein can be used with the ink formulations listed above and other ink products without limitation. Specifically, many other ink compositions may be employed including those recited in U.S. Pat. No. 5,185,034 which is incorporated herein by reference.

B. The Ink Containment Vessels

The ink containment vessels of the present invention (including those listed above and illustrated in FIGS. 1–3) are constructed of special materials which effectively prevent air and volatile components from passing therethrough. These particular materials will now be described in detail and are applicable to many different ink containment structures including the housing 12 in FIG. 1 and the housing 172 in FIGS. 2–3. As shown in FIG. 1, reference number 200 is used to designate the overall side wall structure which defines the entire housing 12, with side wall 200 being produced from the claimed barrier compositions. Likewise, as illustrated in FIG. 2, reference number 202 is used to designate the overall side wall structure which defines the entire housing 172, with side wall 202 being produced from the claimed materials.

The side walls of the novel ink containment vessels are produced from one of three formulations which will now be discussed. The selection of any given formulation will be undertaken in accordance with preliminary pilot testing involving numerous factors including the chemical content of the ink composition being used, the overall configuration of the ink delivery system, and other related considerations. All of the materials described below have a number of common attributes, namely, their ability to produce an ink containment vessel which is resistant to the corrosive effects of ink materials, is substantially fluid/gas impermeable, is dimensionally stable, and provides all of the other benefits listed above. The claimed materials are therefore related in view of their functional attributes and other important features. For this reason, they all constitute "barrier compositions" in accordance with their ability to store ink materials within the claimed vessels in a highly efficient and ink-resistant manner.

1. Formulation No. 1

In a first embodiment, the side walls of the claimed ink containment vessels (including but not limited to those listed above) are constructed from a material designated herein as "polyethylene naphthalate" (e.g. "PEN") which is also known as a homopolymer of dimethyl 2,6-naphthalenedicarboxylate and ethylene glycol. It specifically has the following chemical structure (with either alternative being applicable):

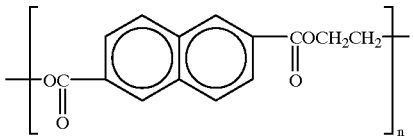

In a non-limiting preferred embodiment, n=about 10–1000 in the above-listed structure.

Regarding the chemical characteristics of this material, they involve a tensile strength of 32,000 lbs./sq. in. and a tensile modulus of 750,000 lbs./sq. in. The water vapor transmission rate of polyethylene naphthalate has been reported in the vicinity of 3.6 gm/m$^2$/day. These parameters were determined according to a standardized procedure referenced in ASTM D-882-88. Polyethylene naphthalate also has a glass transition temperature ($T_g$) of approximately 120° C. and a melting temperature of 262° C. Compared to, for example, polyethylene terephthalate ("PETE"), polyethylene naphthalate has a 43° C. higher glass transition temperature, a 50% higher tensile modulus, a 33% higher tensile strength, a five-fold improvement in its ability to function as a gas barrier (as measured in accordance with biaxially-oriented films), a three-fold improvement in hydrolysis resistance, a four-fold enhancement in moisture barrier capacity, and greater chemical resistance.

In this regard, polyethylene naphthalate is highly beneficial when used to manufacture the side wall of an ink containment vessel (including side walls 200, 202) in accordance with its considerable degree of chemical resistance to the corrosive effects of ink materials, the ability to withstand relatively high temperatures which are traditionally encountered during the manufacturing processes associated with ink containment vessel fabrication, low moisture absorption, low water vapor transmission, a high retention of tensile strength even after being exposed to hydrolysis conditions, a high continuous use temperature in an electrical environment, and the ability to be formed into many shapes in a rapid and effective manner using conventional injection molding techniques. Polyethylene naphthalate provides all of these benefits yet is economical from a material cost standpoint. Thus, the use of polyethylene naphthalate for the purposes specified herein offers many advantages and represents a significant technical advance in the art of ink containment vessel fabrication.

While polyethylene naphthalate may be obtained from a number of different sources, it is commercially available from, for example, Imperial Chemical Industries ("ICI") of Wilmington, Del. (USA) under the trademark "KALADEX" and from Amoco Polymers, Inc. of Alpharetta, Ga. (USA).

At this point, it should again be emphasized that the present invention and its various embodiments shall not be restricted to any particular compositions, materials, proportions, amounts, and other parameters unless otherwise stated herein. All numerical values and ranges presented in this section are provided for example purposes only and represent preferred embodiments of the invention designed to achieve maximum operational efficiency. Regarding the overall thickness of the side wall structures made from polyethylene naphthalate in this embodiment (including but not limited to side wall 200 of housing 12 and side wall 202 of housing 172), it is preferred that a uniform thickness range of about 0.5–1.0 mm be employed. This range is subject to variation as needed based on routine preliminary testing. Also, many different construction methods may be used to produce the claimed ink containment vessels from polyethylene naphthalate including conventional plastic extrusion or injection molding techniques known in the art for plastic component fabrication.

2. Formulation No. 2

In a second embodiment, the side walls of the claimed ink containment vessels (including but not limited to those listed above) are constructed from at least one or more "liquid crystal polymers". The term "liquid crystal polymer" shall be defined herein to involve a class of thermoplastic polymers that exhibit a highly ordered structure in both the melt and solid states and incorporate an aromatic backbone. In particular, liquid crystal polymers are made up entirely of aromatic monomers. The aromatic character of liquid crystal polymers as a general class contributes to the beneficial ink-resistant characteristics thereof, excellent mechanical properties, and a high degree of thermal/thermooxidative stability. The ordered character of liquid crystal polymers is likewise another distinguishing feature of these materials relative to other polymeric compounds. Accordingly, liquid crystal polymers are readily molded or otherwise fabricated in a wide variety of configurations using standard production methods. The term "aromatic" as used in this discussion shall encompass materials which contain one or more benzene ring units therein. In addition, from a structural standpoint as discussed in the *Encyclopedia of Polymer Science and Engineering* (Kroschwitz, J. ed.), Vol. 9 (entitled "Liquid Crystal Polymers to Mining Applications), John Wiley & Sons, Inc., New York (1987), pp. 1–8 (incorporated herein by reference), liquid crystal polymers shall further be defined to involve a "succession of para-oriented ring structures to give a stiff chain with a high axial ratio (ratio of length of molecule to its width, aspect ratio) x." As further stated in this reference, "The common structural feature of low molecular weight LC compounds is asymmetry of molecular shape, manifested either as rods characterized by a uniaxial order with an axial ratio usually greater than three or by thin platelets with biaxial order."

Liquid crystal polymers are particularly useful in producing the claimed ink containment vessels when ink materials are employed that are especially corrosive. The term "corrosive" shall again involve the ability of a particular chemical to dissolve or otherwise deteriorate a given material. Accordingly, the use of liquid crystal polymers to form the side wall of an ink containment vessel (particularly in thermal inkjet systems) offers many advantages and therefore constitutes another substantial advance in the art of ink delivery technology.

This embodiment of the invention shall not be restricted to any particular liquid crystal polymers or combinations thereof. Either one liquid crystal polymer or multiple liquid crystal polymers may be used in combination without limitation. Exemplary and non-limiting examples of liquid crystal polymers which can be employed for the construction of an ink containment vessel as indicated above (including those shown in FIGS. 1–3) shall involve the following commercially-available liquid crystal polymer materials:

1. A product sold under the name/trademark "Vectra" by the Hoechst Co. of Summit, N.J. (USA). From a chemical standpoint, this proprietary composition essentially consists of a wholly aromatic polyester/polyamide made from aromatic diacids, aromatic dialcohols, and aromatic moieties with two different substituents, with the substituents involving alcohols, acids, or amines. In particular, the "Vectra" line of liquid crystal polymers involves several compositions including but not limited to: (A) p-hydroxybenzoic acid modified with 2-oxynaphthalene-6-carbonyl units; or (B) 2,6-dioxynaphthalene modified with terephthaloyl units.

2. A product sold under the name/trademark "Xydar" by Amoco Polymers, Inc. of Alpharetta, Ga. (USA). Chemically, this composition basically consists of a product of the modification of p-hydrobenzoic acid with 4,4'-biphenol and terephthalic acid.

3. A product sold under the name/trademark "Zenite" by E. I. DuPont de Nemours & Company of Wilmington, Del. (USA).

Other liquid crystal polymers which may be employed include but are not limited to the following materials: aromatic polyamides, aromatic polyoxamides, aromatic polyhydrazides, aromatic poly(oxalic hydrazides), aromatic poly(amine hydrazides), poly(p-phenylenebenzobisthiazole), and polyimides.

Regarding the overall thickness of the side wall structures made from at least one or more liquid crystal polymers in this embodiment (including side wall 200 of housing 12 and side wall 202 of housing 172), it is preferred that a uniform thickness range of about 0.5–1.0 mm be employed. This range is subject to variation as needed based on routine preliminary testing. Also, many different construction methods may again be employed without limitation in order to produce the claimed ink containment vessels from liquid crystal polymers including conventional plastic extrusion or injection molding techniques known in the art for plastic component fabrication.

3. Formulation No. 3

Finally, in a third embodiment, the novel ink containment vessels of the present invention may be constructed from polyethylene naphthalate in combination with at least one or more liquid crystal polymers as defined above to form a polyethylene naphthalate/liquid crystal polymer "blend". All of the information, parameters, examples, commercial sources, and other data presented above regarding polyethylene naphthalate and liquid crystal polymers as employed in the first and second embodiments shall be equally applicable to and incorporated by reference in this embodiment. The use of at least one liquid crystal polymer in combination with polyethylene naphthalate is designed to further enhance the beneficial characteristics discussed above (including improved chemical resistance to ink materials and the control of gas/liquid permeability problems). The use of at least one liquid crystal polymer in combination with polyethylene naphthalate is designed to further enhance the beneficial characteristics discussed above (including improved chemical resistance to ink materials and the control of gas/liquid permeability problems). In particular, blends involving polyethylene naphthalate and at least one liquid crystal polymer in combination enable the best features of both compositions to be employed in a single mixed compound. Thus, by using a blend of both materials, the resulting product (from a chemical composition standpoint) can be appropriately "adjusted" as needed to properly tailor the ink containment vessel to the type of ink composition under consideration. In other words, by selectively controlling the amount of each material in the chosen blend, the desired characteristics to be imparted to the ink containment vessel can be accurately selected in accordance with preliminary pilot studies on the ink compositions being delivered. Thus, the use of at least one liquid crystal polymer in combination with polyethylene naphthalate to produce the side wall of an ink containment vessel provides an even further advance in the art of ink delivery technology.

The present invention shall not be restricted to the use of any specific liquid crystal polymers in the applications discussed above. The novelty associated with this embodiment resides in the general combination of polyethylene naphthalate with at least one liquid crystal polymer to form the side wall of an ink containment vessel without regard to the specific liquid crystal polymers under consideration. However, exemplary and non-limiting examples of liquid crystal polymers which may be employed for the purposes recited herein shall involve the list of materials and commercial sources provided above in the discussion of Formulation No. 2, with this information being incorporated by reference relative to Formulation No. 3.

In accordance with the present embodiment which involves a combination of (1) polyethylene naphthalate; and (2) at least one or more liquid crystal polymers as previously noted, the claimed invention shall not be restricted to any specific numerical proportions. However, in a representative example designed to provide optimum results, the side wall of the selected ink containment vessel will contain about 10–50% by weight polyethylene naphthalate and about 50–90% by weight total liquid crystal polymer (whether a single material is used or multiple liquid crystal polymers are employed in combination, with the range listed above involving the total amount of liquid crystal polymers being used).

Regarding the overall thickness of the side wall structures made from a combination of polyethylene naphthalate and at least one or more liquid crystal polymers in this embodiment (including side wall 200 of housing 12 and side wall 202 of housing 172), it is preferred that a uniform thickness range of about 0.5–1.0 mm be employed. This range is again subject to variation as needed based on routine preliminary testing. Also, many different construction methods may be employed without limitation in order to produce the claimed ink containment vessels from polyethylene naphthalate/liquid crystal polymer blends. These methods include conventional plastic extrusion or injection molding techniques known in the art for plastic component fabrication.

C. Additional Information and Methods of Use

In accordance with the information provided above, novel ink containment vessels with a high degree of structural integrity can be fabricated from the following barrier materials: (1) polyethylene naphthalate; (2) at least one or more liquid crystal polymers; or (3) a combination of polyethylene naphthalate with at least one or more liquid crystal polymers. Likewise, the claimed ink containment vessels and specialized barrier materials may be used in many different ink delivery systems without limitation provided that they include a printhead comprising at least one ink ejector for expelling ink on demand. The selected ink containment vessel is then operatively connected to the printhead, with the term "operatively connected" being defined to involve direct physical attachment to the printhead or remote attachment using one or more ink transfer conduits. Likewise, the ink containment vessels described herein shall encompass any type of ink-holding receptacle having a side wall produced from the claimed barrier compositions listed above.

In addition to the structures discussed in the foregoing sections, the present invention also involves a general method for preventing ink evaporation or leakage from an ink delivery system having a directly-attached or remotely-located supply of ink associated therewith. The claimed method is also designed to prevent the introduction of air into the ink supply and to likewise improve the chemical-resistance of the ink containment vessels. This method generally involves the initial step of providing an ink delivery system which includes a printhead having at least one ink ejector for expelling ink on demand (See FIGS. 1–3 and the discussion provided above in Section "A" which is incorporated by reference in this section). The next step involves storing a supply of ink (see Section "A") within an ink containment vessel that is operatively connected to and in fluid communication with the printhead. The ink containment vessel (consisting of an appropriate housing, tank, or the like as discussed in Section "A") again includes a side wall which prevents air and volatile ink components from passing therethrough. The side wall of the ink containment vessel is produced from [1] polyethylene naphthalate; [2] at least one or more liquid crystal polymers; or [3] polyethylene naphthalate combined with at least one or more liquid crystal polymers to form a "blend" as previously discussed. All of the information provided above in Section "B" regarding these specialized barrier materials shall be equally applicable to and incorporated by reference in this section. For example, when a blend of polyethylene naphthalate and at least one or more liquid crystal polymers is employed in the claimed method, the present invention shall not be restricted to any particular numerical proportions as noted above. However, in a representative example designed to provide optimum results, the side wall of the selected ink containment vessel in this embodiment will again contain about 10–50% by weight polyethylene naphthalate and about 50–90% by weight total liquid crystal polymer (whether a single material is used or multiple polymers are employed in combination, with the range listed above involving the total amount of liquid crystal polymers included in the combination). However, the selection of any of the novel barrier materials listed in Section "B" for producing the chosen ink containment vessel will provide the many important benefits discussed herein.

In conclusion, the novel ink containment vessels and ink storage methods described above provide many important benefits. These benefits include (1) the avoidance of ink corrosion problems and ink leakage from the ink delivery system; (2) the prevention of air entry into the ink supply and printhead; and (3) the control of ink evaporation and losses of volatile ink components. The completed ink containment vessels are dimensionally stable during and after production. All of these benefits (which are a direct consequence of the claimed barrier materials) are provided in a manner which is cost effective and suitable for mass production manufacturing processes. As a result, high levels of operating efficiency, print quality, longevity, and overall economy are maintained.

Having herein set forth preferred embodiments of the invention, it is anticipated that suitable modifications may be made thereto by individuals skilled in the relevant art which nonetheless remain within the scope of the invention. For example, the invention shall not be limited to any particular ink delivery systems, ink ejectors, operational parameters, dimensions, ink compositions, and component orientations within the general guidelines set forth above unless otherwise stated herein. Likewise, any references to components in the singular shall likewise encompass the use of such components in multiple quantities unless otherwise indicated above. The present invention shall therefore only be construed in accordance with the following claims:

The invention that is claimed is:

1. An ink delivery system for use in printing images on a substrate comprising:

a printhead comprising at least one ink ejector for expelling ink on demand from said printhead; and an ink containment vessel operatively connected to and in fluid communication with said printhead, said ink containment vessel comprising a side wall which is comprised of a barrier composition that prevents air and volatile ink components from passing therethrough, said barrier composition being comprised of polyethylene naphthalate.

2. An ink delivery system for use in printing images on a substrate comprising:

a printhead comprising at least one ink ejector for expelling ink on demand from said printhead; and an ink containment vessel operatively connected to and in fluid communication with said printhead, said ink containment vessel comprising a side wall which is comprised of a barrier composition that prevents air and volatile ink components from passing therethrough, said barrier composition being comprised of polyethylene naphthalate and at least one liquid crystal polymer in combination to form a blend thereof.

3. A method for improving the chemical-resistance of an ink delivery system comprising a supply of ink for use in printing images on a substrate, said method preventing the introduction of air into said supply of ink and avoiding the loss of volatile ink components therefrom, said method comprising:

providing an ink delivery system comprising a printhead, said printhead comprising at least one ink ejector for expelling ink on demand from said printhead; and storing a supply of ink within an ink containment vessel operatively connected to and in fluid communication with said printhead, said ink containment vessel comprising a side wall which is comprised of a barrier composition that prevents air and volatile ink components from passing therethrough, said barrier composition being comprised of polyethylene naphthalate.

4. A method for improving the chemical-resistance of an ink delivery system comprising a supply of ink for use in printing images on a substrate, said method preventing the introduction of air into said supply of ink and avoiding the loss of volatile ink components therefrom, said method comprising:

providing an ink delivery system comprising a printhead, said printhead comprising at least one ink ejector for expelling ink on demand from said printhead; and storing a supply of ink within an ink containment vessel operatively connected to and in fluid communication with said printhead, said ink containment vessel comprising a side wall which is comprised of a barrier composition that prevents air and volatile ink components from passing therethrough, said barrier composition being comprised of polyethylene naphthalate and at least one liquid crystal polymer in combination to form a blend thereof.

5. An ink containment vessel for use with an ink delivery system, said ink containment vessel comprising a side wall having a thickness of about 0.5–1.0 mm, said side wall being comprised of a barrier composition that prevents air and volatile ink components from passing therethrough, said barrier composition being comprised of polyethylene naphthalate.

6. An ink containment vessel for use with an ink delivery system, said ink containment vessel comprising a side wall having a thickness of about 0.5–1.0 mm, said side wall being comprised of a barrier composition that prevents air and volatile ink components from passing therethrough, said barrier composition being comprised of at least one liquid crystal polymer.

7. An ink containment vessel for use with an ink delivery system, said ink containment vessel comprising a side wall having a thickness of about 0.5–1.0 mm, said side wall being comprised of a barrier composition that prevents air and volatile ink components from passing therethrough, said barrier composition being comprised of polyethylene naphthalate and at least one liquid crystal polymer in combination to form a blend thereof.

8. An ink containment vessel for use with an ink delivery system, said ink containment vessel comprising a side wall which is comprised of a barrier composition that prevents air and volatile ink components from passing therethrough, said barrier composition being comprised of polyethylene naphthalate and at least one liquid crystal polymer in combination to form a blend thereof, said blend comprising about 10–50% by weight said polyethylene naphthalate and about 50–90% by weight said liquid crystal polymer.

9. An ink delivery system for use in printing images on a substrate comprising:

a printhead comprising at least one ink ejector for expelling ink on demand from said printhead; and an ink containment vessel operatively connected to and in fluid communication with said printhead, said ink containment vessel comprising a side wall having a thickness of about 0.5–1.0 mm, said side wall being comprised of a barrier composition that prevents air and volatile ink components from passing therethrough, said barrier composition being comprised of polyethylene naphthalate.

10. An ink delivery system for use in printing images on a substrate comprising:

a printhead comprising at least one ink ejector for expelling ink on demand from said printhead; and an ink containment vessel operatively connected to and in fluid communication with said printhead, said ink containment vessel comprising a side wall having a thickness of about 0.5–1.0 mm, said side wall being comprised of a barrier composition that prevents air and volatile ink components from passing therethrough, said barrier composition being comprised of at least one liquid crystal polymer.

11. An ink delivery system for use in printing images on a substrate comprising:

a printhead comprising at least one ink ejector for expelling ink on demand from said printhead; and an ink containment vessel operatively connected to and in fluid communication with said printhead, said ink containment vessel comprising a side wall having a thickness of about 0.5–1.0 mm, said side wall being comprised of a barrier composition that prevents air and volatile ink components from passing therethrough, said barrier composition being comprised of polyethylene naphthalate and at least one liquid crystal polymer in combination to form a blend thereof.

12. An ink delivery system for use in printing images on a substrate comprising:

a printhead comprising at least one ink ejector for expelling ink on demand from said printhead; and an ink containment vessel operatively connected to and in fluid communication with said printhead, said ink containment vessel comprising a side wall which is comprised of a barrier composition that prevents air and volatile ink components from passing therethrough, said barrier composition being comprised of polyethylene naphthalate and at least one liquid crystal polymer in combination to form a blend thereof, said blend comprising about 10–50% by weight said polyethylene naphthalate and about 50–90% by weight said liquid crystal polymer.

13. A method for improving the chemical-resistance of an ink delivery system comprising a supply of ink for use in printing images on a substrate, said method preventing the introduction of air into said supply of ink and avoiding the loss of volatile ink components therefrom, said method comprising:

providing an ink delivery system comprising a printhead, said printhead comprising at least one ink ejector for expelling ink on demand from said printhead; and storing a supply of ink within an ink containment vessel operatively connected to and in fluid communication with said printhead, said ink containment vessel comprising a side wall having a thickness of about 0.5–1.0 mm, said side wall being comprised of a barrier composition that prevents air and volatile ink components from passing therethrough, said barrier composition being comprised of polyethylene naphthalate and at least one liquid crystal polymer in combination to form a blend thereof.

14. A method for improving the chemical-resistance of an ink delivery system comprising a supply of ink for use in printing images on a substrate, said method preventing the introduction of air into said supply of ink and avoiding the loss of volatile ink components therefrom, said method comprising:

providing an ink delivery system comprising a printhead, said printhead comprising at least one ink ejector for expelling ink on demand from said printhead; and storing a supply of ink within an ink containment vessel operatively connected to and in fluid communication with said printhead, said ink containment vessel comprising a side wall which is comprised of a barrier composition that prevents air and volatile ink components from passing therethrough, said barrier composition being comprised of polyethylene naphthalate and at least one liquid crystal polymer in combination to form a blend thereof, said blend being comprised of about 10–50% by weight said polyethylene naphthalate and about 50–90% by weight said liquid crystal polymer.

* * * * *